US006839931B2

(12) United States Patent
Chen

(10) Patent No.: US 6,839,931 B2
(45) Date of Patent: Jan. 11, 2005

(54) BATHING BRUSH WITH DOUBLE CLEANING BALLS

(76) Inventor: Chen Ching Chen, No. 80-2, Wung-Yuann Rd., Pei-Dou Cheng, Chang-Hau Hsien (TW)

( * ) Notice: Subject to any disclaimer, the term of this patent is extended or adjusted under 35 U.S.C. 154(b) by 0 days.

(21) Appl. No.: 10/443,038

(22) Filed: May 22, 2003

(65) Prior Publication Data

US 2004/0231085 A1 Nov. 25, 2004

(51) Int. Cl.[7] ..... A47K 7/02; A47L 17/08; A47L 13/10

(52) U.S. Cl. ..... 15/209.1; 15/210.1; 15/229.11; 15/229.13; 300/21

(58) Field of Search ..... 15/209.1, 210.1, 15/229.11, 229.12, 229.13, 222; D32/40, 43

(56) References Cited

U.S. PATENT DOCUMENTS 5,144,744 A 9/1992 Campagnoli
5,983,435 A * 11/1999 Osborne ..... 15/209.1
6,038,727 A 3/2000 Chen
6,092,258 A 7/2000 Chen
6,112,363 A 9/2000 Chen
6,131,234 A 10/2000 Chen
6,368,003 B1 * 4/2002 Sorrell ..... 401/185
2003/0051304 A1 * 3/2003 Chang ..... 15/209.1

* cited by examiner

*Primary Examiner*—Robert J. Warden, Sr.
*Assistant Examiner*—Laura C Cole
(74) *Attorney, Agent, or Firm*—Dennison, Schultz, Dougherty & MacDonald

(57) ABSTRACT

A bathing brush has a first cleaning ball composed of a first net tube, a second cleaning ball composed of a second net tube, a separation device provided between the first and second cleaning balls having a gripping portion at a periphery thereof and at least a hole at a center thereof, and a connection device running through the hole of the separation device and wound around the net tubes to bond the net tubes at opposite sides of the separation device respectively and make the net tubes expanded to form the first second cleaning balls.

10 Claims, 5 Drawing Sheets

BATHING BRUSH WITH DOUBLE CLEANING BALLS

BACKGROUND OF THE INVENTION

1. Field of the Invention

The present invention relates generally to a bathing tool, and more particularly to a bathing brush with double cleaning balls at opposite sides respectively to provide different cleaning capacities.

2. Description of the Related Art

In the prior art, U.S. Pat. No. 5,144,744 disclosed a bathing brush made of a flexible net tube. Such bathing brush is made into a ball-like element. An improved bathing brush consists of a series of cleaning balls as shown in U.S. Pat. No. 6,112,363, which the brush has a longer area for cleaning. Another improved bathing brush is taught by U.S. Pat. No. 6,131,234 which a flexible net tube is wound into a double-ball element to facilitate user holding it. U.S. Pat. No. 6,092,258 disclosed a bathing brush having an elongated handle with three cleaning balls fixed on it.

There were many inventions teaching a cleaning ball composed of flexible net tubes with various material capacities or shapes, and then the net tubes are bonded together, in series connection or in parallel connection, and made into a predetermined shape. Such invention typically is taught by U.S. Pat. No. 6,038,727 and this kind of bathing brush is simply made of different types of flexible net tubes.

We still have not found in the prior art that a connection device is provided to bond two cleaning balls at opposite sides thereof.

SUMMARY OF THE INVENTION

The primary objective of the present invention is to provide a bathing brush, which has double cleaning balls thereon with different cleaning capacities for the choice of user.

The secondary objective of the present invention is to provide a bathing brush having a connection device fixed on a handle to form an independent cleaning ball at each side thereof.

According to the objectives of the present invention, a bathing brush comprises a first cleaning ball composed of at least a net tube, wherein the net tube has a suitable length and a suitable flexibility to be bonded at a portion, a second cleaning ball composed of at least a net tube, wherein the net tube has a suitable length and a suitable flexibility to be bonded at a portion, a separation device provided between the first cleaning ball and the second cleaning ball having a gripping portion at a periphery thereof and at least a hole at a center thereof, and a connection device, wherein the connection device runs through the hole of the separation device and is wound around the net tubes to bond the net tubes at opposite sides of the separation device respectively and make the net tubes expanded to form the first cleaning ball and the second cleaning ball respectively.

DETAILED DESCRIPTION OF THE INVENTION

Figure 1:
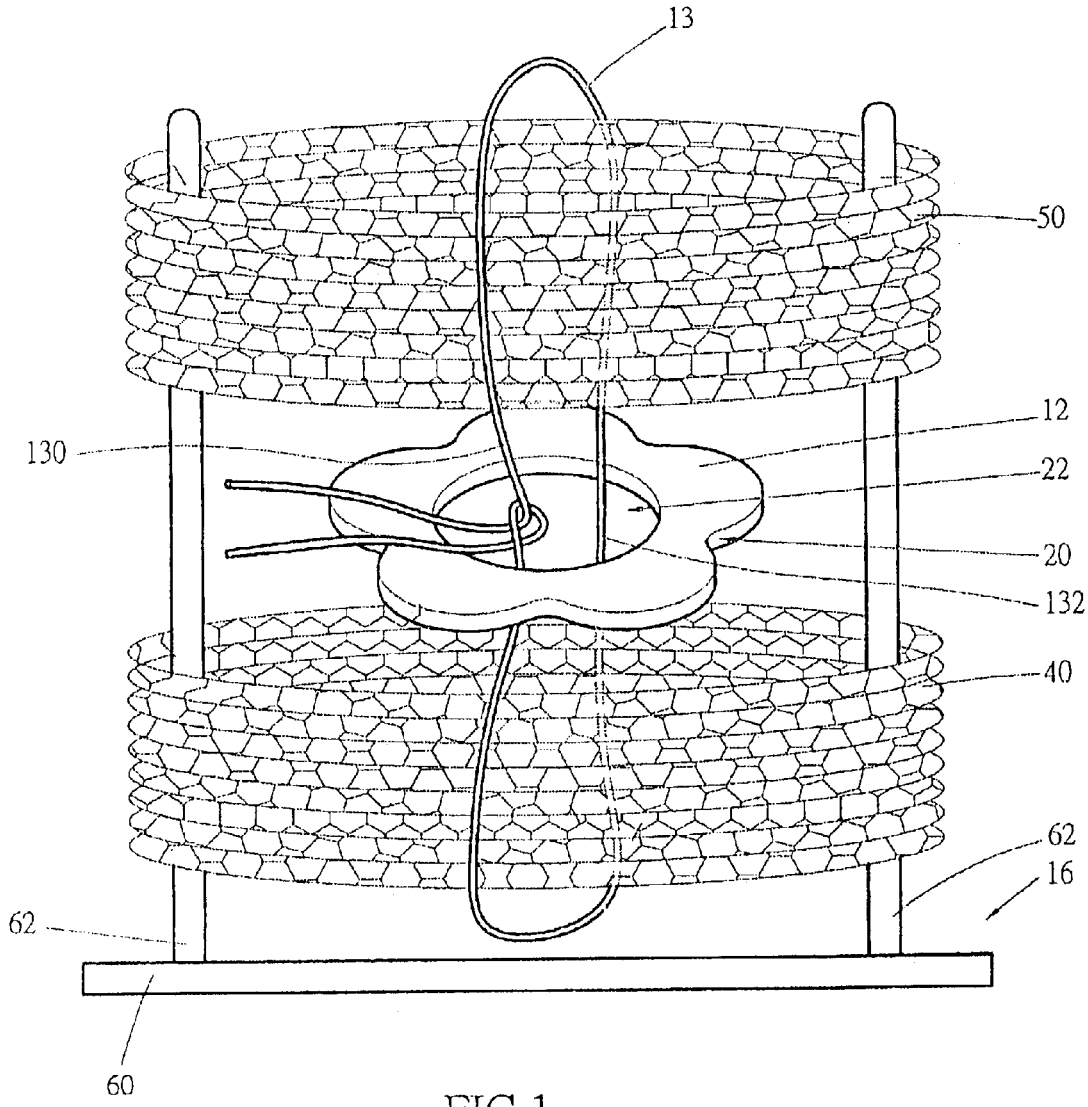
FIG. 1 is a perspective view of a first preferred embodiment of the present invention.
Figure 2:
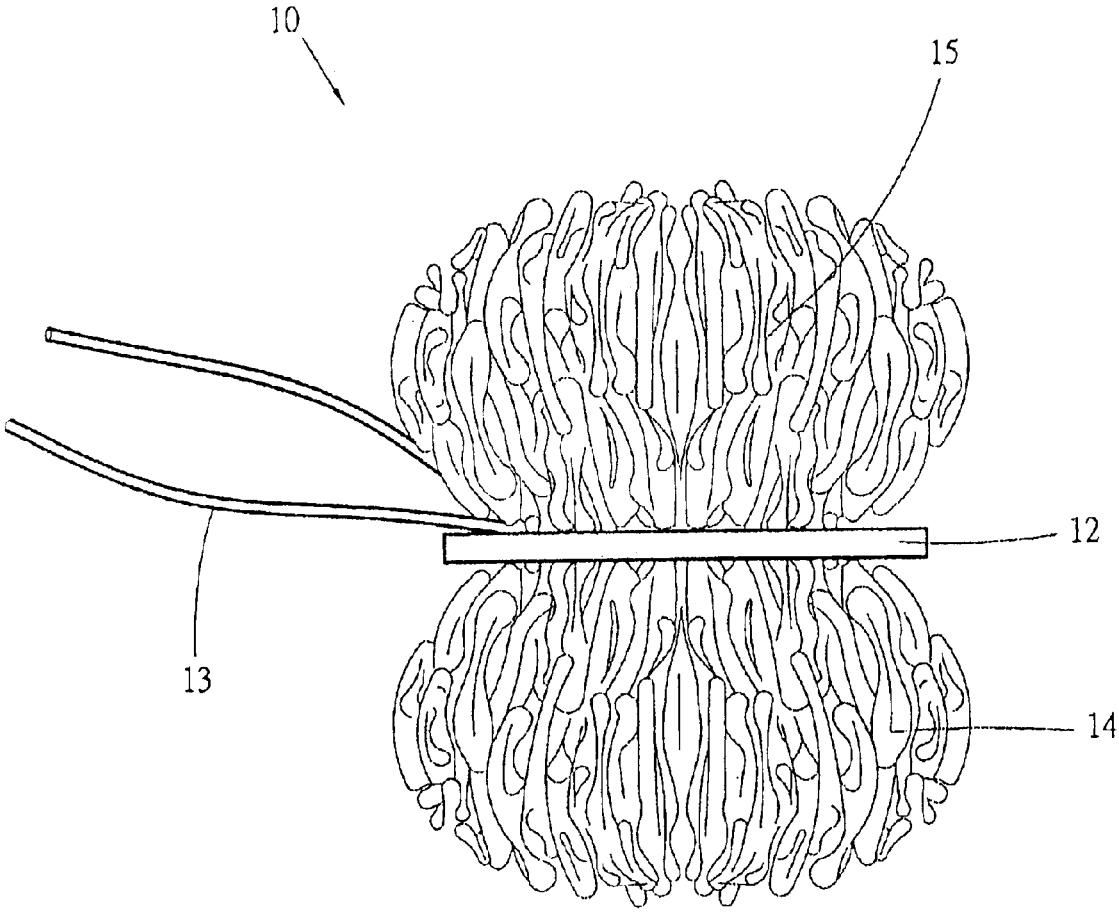
FIG. 2 is a front view of the first preferred embodiment of the present invention.

As shown in FIG. 1 and FIG. 2, a bathing brush 10 of the first preferred embodiment of the present invention mainly comprises a separation device 12, a connection device 13, a first cleaning ball 14 and a second cleaning ball 15.

The separation device 12 is flat having recesses at a periphery thereof to form a gripping portion 20 and a hole 22 at a center thereof. The connection device 13 has a rope made of cotton or plastic with a suitable length.

In combination, a mold 16 having a base 60 and two parallel posts 62 at a top of the base 60 is prepared to manufacture the bathing brush 10 of the present invention. A first net tube 40 and a second net tube 50 to form the first and second cleaning balls 14 and 15 are prepared at the same time.

The first and second net tubes 40 and 50 are wound on the posts 62 of the mold 16 in loose conditions, wherein the second net tube 50 is above the first net tube 40. The first and second net tubes 40 and 50 are respectively compressed toward centers thereof to form waves at peripheries thereof. The separation device 12 is arranged at between the first and second net tubes 40 and 50 which axes of winding orientations of the first and second net tubes 40 and 50 and an axis of the hole 22 of the separation device 12 are parallel. The connection device 13 is curved into a ring and runs through the hole 22 of the separation device 12 and runs around the first and second net tubes 40 and 50 respectively. And then, two ends of the connection device 13 is pulled to make the first and second net tubes 40 and 50 having midsections thereof concentrated in the hole 22 of the separation device 13 and rest parts of the first and second net tubes 40 and 50 expanded to form the first and second cleaning balls 14 and 15 respectively as shown in FIG. 2.

The bathing brush 10 of the first preferred embodiment of the present invention has a function to be hung at some where. According to above, the connection device 13 is pulled out and left sections adjacent to the ends thereof out and tied a knot. This section or the connection device 13 makes the bathing brush 10 of the present invention can be hung on a hook or something like it. The left-out sections of the connection device 13 might interfere with user using the bathing brush 10 of the present invention so that the left-out sections of the connection device 13 are preferred between the first and second cleaning balls 14 and 15, in other words, the left-out sections of the connection device 13 are preferred extended laterally from the separation device 12.

The characters in the structure of the bathing brush 10 of the present invention are:

1. Only one connection device 13 is provided and extended through the separation device 12 to bond the flexible net tubes 40 and 50, whereby the net tubes 40 and 50 are bonded at the opposite sides of the separation device 12 to form the cleaning balls 14 and 15.

2. The connection device 13 runs through the hole 22 of the separation device 13 laving two sections 130 and 132 separated from each other in a suitable distance that stabilize the cleaning balls 14 and 15 to prevent them from shaking.

Figure 3:
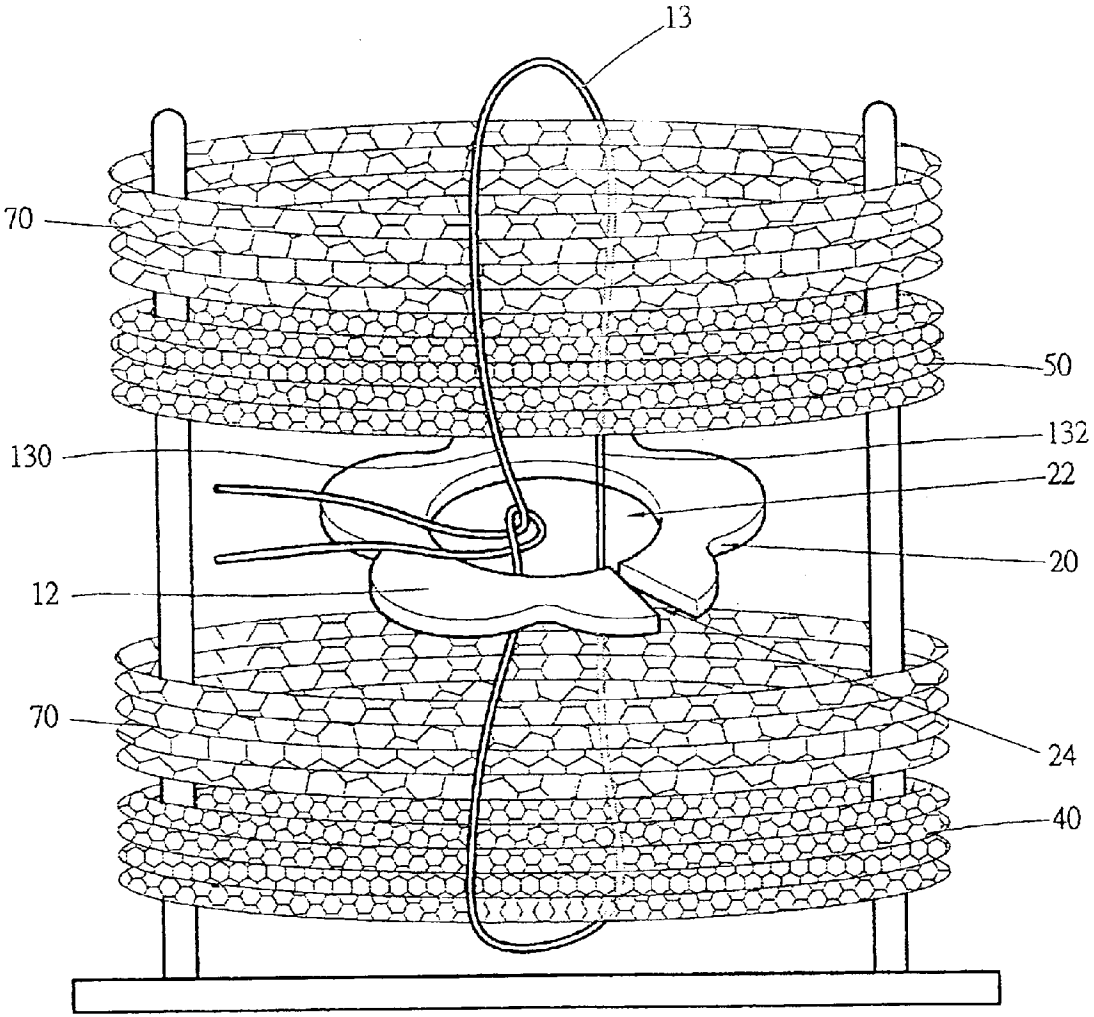
FIG. 3 is a perspective view of a second preferred embodiment of the present invention.

The second preferred embodiment of the present invention is shown in FIG. 3, wherein the post 62 of the mold 16 is further wound with two third net tubes 70 and each of which is connected with the first or the second net tube 40 or 50 in series connection or parallel connection so that each of the cleaning balls 14 and 15 is composed of two net tubes 40 or 50 and 70. The cleaning balls 14 and 15, therefore, have various structures in shapes, colors and touching feelings.

The separation device 12 of the second preferred embodiment is provided with a gap 24 between the gripping portion 20 and the hole 22. The gap 24 has a width at an end thereof adjacent to the periphery of the separation device 13 larger than a width at the other end thereof adjacent to the hole 22. The width of the gap 24 at the end adjacent to the hole 22 is smaller than the distance between the sections 130 and 132 of the connection device 13.

Whereby, while the first and second cleaning balls 14 and 15 are bonded by the connection device 13, the separation device 12 is inserted in between the first and second cleaning balls 14 and 15 with the connection device 13 running into the hole 22 via the gap 24, and then the separation device 12 is rotated for 90 degrees to make the sections 130 and 132 can not escape from the separation device 12 via the gap 24 anymore.

Figure 4:
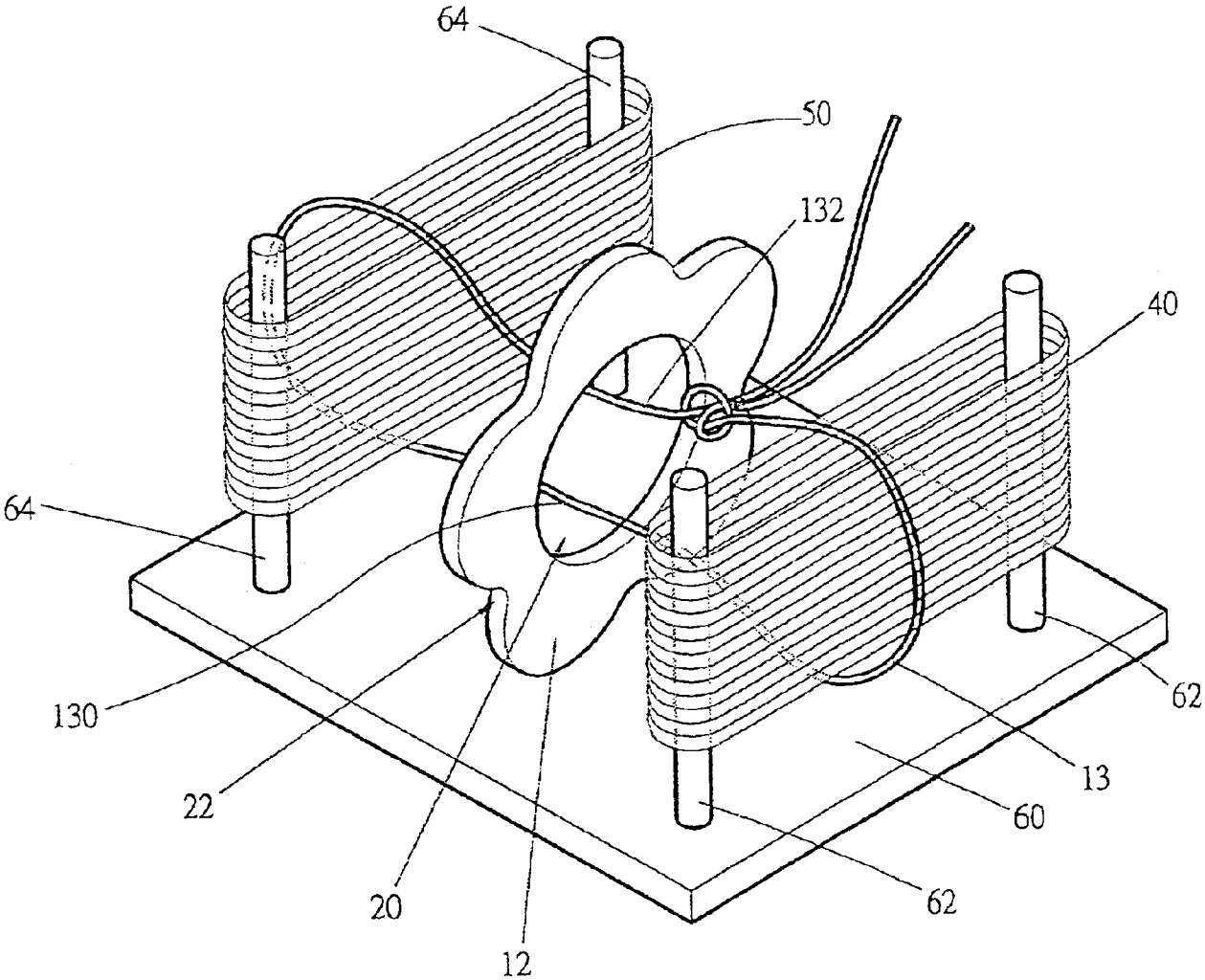
FIG. 4 is a perspective view of a third preferred embodiment of the present invention.

FIG. 4 shows the third preferred embodiment of the present invention which two pairs of posts 62 and 64 are provided on the mold 16 and the first and second net tubes 40 and 50 are wound on each pair of the post 62 and 64 respectively and the separation device 12 is arranged between the first and second net tubes 40 and 50. The axes of winding orientations of the first and second net tubes 40 and 50 are parallel to each other but are perpendicular to an axis of the hole 22 of the separation device 12. The structure of third preferred embodiment makes the first and second net tubes 40 and 50 expended in ways different from the first preferred embodiment but both of them have the same function of cleaning.

Figure 5:
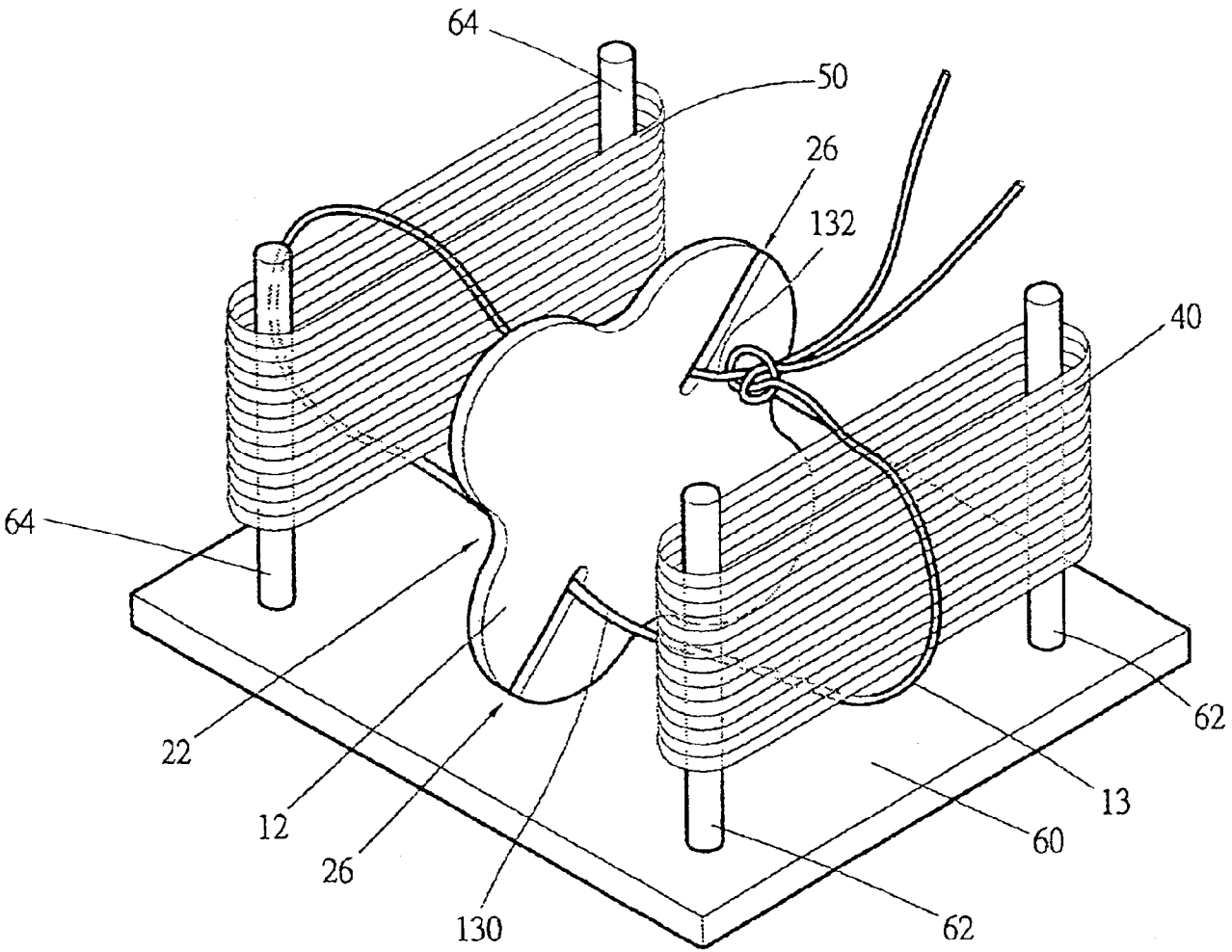
FIG. 5 is a perspective view of a fourth preferred embodiment of the present invention.

FIG. 5 shows of the fourth preferred embodiment which the bathing brush 10 is similar to the bathing brushes in the aforesaid preferred embodiments, except that a separation device 12 is provided with two slots 26 for replacement with the hole 22. An angle between the slots 26 is 180 degrees. The sections 130 and 132 are received in the slots 26 respectively and are against bottoms of the slots 26.

What is claimed is:

1. A bathing brush, comprising:

a first cleaning ball composed of at least a net tube, wherein the net tube has a suitable length and a suitable flexibility to be bonded at a predetermined portion;

a second cleaning ball composed of at least a net tube, wherein the net tube has a suitable length and a suitable flexibility to be bonded at a predetermined portion;

a separation device provided between the first cleaning ball and the second cleaning ball having a gripping portion at a periphery thereof and at least a hole at a center thereof, and a connection device having a suitable length and a suitable flexibility, wherein the connection device runs through the hole of the separation device and is wound around the net tubes to bond the net tubes at opposite sides of the separation device respectively and make the net tubes expanded to form the first cleaning ball and the second cleaning ball respectively.

2. The bathing brush as defined in claim 1, wherein axes of winding orientations of the net tubes and an axis of the hole of the separation device are parallel.

3. The bathing brush as defined in claim 1, wherein axes of winding orientations of the net tubes are parallel to each other but are perpendicular to an axis of the hole of the separation device.

4. The bathing brush as defined in claim 1, wherein the connection device is a rope with a predetermined length which opposite ends thereof are extended out between the first cleaning ball and the second cleaning ball.

5. The bathing brush as defined in claim 1, wherein the separation device further has a gap extended from the periphery thereof to the hole.

6. The bathing brush as defined in claim 5, wherein a width of the gap adjacent to the periphery of the separation device is larger than a width of the gap adjacent to the hole.

7. The bathing brush is defined in claim 1, wherein the separation device has two of aforesaid holes for the connection device running through.

8. The bathing brush as defined in claim 1, wherein the separation device has two slots and the connection device is received in the slots respectively and against bottoms of the slots respectively.

9. The bathing brush as defined in claim 1, wherein the first cleaning ball is composed of a first net tube and a third net tube which the net tube are connected with each other in a parallel connection.

10. The bathing brush as defined in claim 1, wherein the first cleaning ball is composed of a first net tube and a third net tube which the net tubes are connected with each other in a series connection.

* * * * *